US006568090B2

(12) United States Patent
Sheffler et al.

(10) Patent No.: US 6,568,090 B2
(45) Date of Patent: May 27, 2003

(54) COSMETIC PENCIL SHARPENER

(76) Inventors: Robert Sheffler, Morganville, NJ (US); Charles Chang, 55 Westview Rd., Wayne, NJ (US) 07470

( * ) Notice: Subject to any disclaimer, the term of this patent is extended or adjusted under 35 U.S.C. 154(b) by 0 days.

(21) Appl. No.: 09/683,008

(22) Filed: Nov. 8, 2001

(65) Prior Publication Data

US 2002/0046470 A1 Apr. 25, 2002

Related U.S. Application Data

(63) Continuation of application No. 09/640,562, filed on Aug. 18, 2000.

(51) Int. Cl.[7] ..... B43L 23/00
(52) U.S. Cl. ..... 30/457
(58) Field of Search ..... 30/454, 457.461

(56) References Cited

U.S. PATENT DOCUMENTS 502,632 A * 8/1893 Norell ..... 30/457

FOREIGN PATENT DOCUMENTS

DE 3737863 * 8/1988 ..... 30/457

* cited by examiner

*Primary Examiner*—Douglas D. Watts
(74) *Attorney, Agent, or Firm*—Richard A. Joel, Esq

(57) ABSTRACT

A cosmetic pencil and sharpener comprises a cap and pencil portion having a sharpened head on a first end portion of the pencil, an elongated body and a second end portion. The cap includes a recess at one end to engage and cover the pencil head, an intermediate portion and a second closed end portion. The intermediate portion includes a raised angular section located adjacent a longitudinal slot in the cap wall. A blade is mounted to the angular section and extends downwardly into the slot. Rotation of the pencil sharpens the head against the blade while shavings drop outwardly from the slot due to a self-cleaning chisel point protrusion on the cap.

6 Claims, 2 Drawing Sheets

COSMETIC PENCIL SHARPENER

CROSS REFERENCE TO RELATED APPLICATIONS

This application is a continuation in part of Ser. No. 09/640,562 filed Aug. 18, 2000.

BACKGROUND OF INVENTION

This invention relates to cosmetic pencils and particularly to a cosmetic pencil sharpener wherein the sharpener is part of the pencil cap and which includes a cleaning portion to remove debris which may accumulate in the vicinity of the cutting blade. In this attractive design, the pencil may be sharpened by merely turning the pencil to engage a blade within the cap. It is unnecessary to carry a separate sharpening device since the cap functions as an integral pencil sharpener.

The prior art includes U.S. Pat. No. 4,485,862 to MATTHEIS, et al, which discloses a cosmetic pencil sharpener with nesting adapter sleeves of progressively smaller diameters for cutting a plurality of different sizes of pencils.

U.S. Pat. No. 4,248,483 to KAYE, discloses a cosmetic pencil sharpener comprising a sharpener unit having a body of rectangular configuration embraced within a casing. In the front end of the sharpener unit is an aperture leading to a bore in which the pencil to be sharpened is inserted.

Design Pat. 251,977 to LAUENBERGER, et al, discloses a dual cosmetic pencil sharpener with two openings for sharpening cosmetic pencils. Design Pat. 262,295 to KAYE, discloses a cosmetic pencil sharpener of a unique design but which is not intended to fit on a pencil. Design Pat. 378,385 to GUERRERO, discloses a cosmetic pencil sharpener apparently in the shape of a pyramid for sharpening cosmetic pencils.

U.S. Pat. No. 5,909,740 to SUSSMAN, is of particular interest since it discloses a combination protective cap and mirror unit for a cosmetic pencil having a sharpened tip but a sharpener is not part of the configuration. U.S. Pat. No. 5,167,071 to EISEN, discloses a sharpener for cosmetic pencils in which the lateral sides of the sharpener housing are provided with complimentary protrusions or recesses that allow fitting together of two sharpeners.

None of the prior art patents disclose the unique attractive design disclosed herein or are such designs as functional and inexpensive as the proposed invention. The self-cleaning feature of applicants invention is a unique advance over the prior art.

SUMMARY OF INVENTION

This invention relates to cosmetic pencils and more specifically to a device for sharpening such pencils. In use, the cosmetic head portion on the pencil, which is encased longitudinally by wood sheathing, becomes dull or the tip may break off. This necessitates looking for and using a separate sharpener to form a new tip, which may be quite inconvenient. This invention proposes a unique sharpener, which is part of the cap for the pencil.

A cosmetic pencil includes a sharpened head with the cosmetic center protruding outwardly from the wood sheathing at the head end, an elongated body and a second closed end. A cap includes a top or end portion with a downwardly extending wall surrounding an axial recess, and includes a second open end to engage the sharpened head with protruding cosmetic.

The cap includes an elongated slot in the wall having an angled side and a flat portion extending outwardly from the slot side at an angle. A blade is mounted to the flat portion and extends inwardly at an angle into the slot to engage a pencil for sharpening purposes. The rear of the flat portion extends upwardly from the cap wall and presents a curved surface rising upwardly from the wall. The cap includes a cleaning portion to prevent debris from accumulating between the cutting edge of the blade and the slot.

In use, one merely rotates the pencil within the cap and the blade shaves back the wooden sheathing to expose and sharpen the cosmetic pencil. The shaved sheathing and cosmetic is discarded via the open slot by a chisel point protrusion that directs the debris outwardly.

Accordingly, an object of this invention is to provide a new and improved sharpener for cosmetic pencils.

Another object of this invention is to provide a new and improved cosmetic pencil sharpener wherein a sharpener comprises part of the cap for the pencil.

A further object of this invention is to provide a new and improved cosmetic pencil sharpener which includes a self-cleaning portion which prevents debris from accumulating between the cutting blade and the slot.

A more specific object of this invention is to provide a new and improved cosmetic pencil sharpener which is part of the cap encasing the pencil head and extends outwardly for mounting a blade thereto which extends at an angle into a slot in the cap to engage the head of the pencil and provide a sharpening action upon turning the pencil with the cap being maintained in a fixed position while a self-cleaning protrusion directs debris outwardly from the slot.

BRIEF DESCRIPTION OF DRAWINGS

The above and other objects and advantages of this invention may be more clearly seen when viewed in conjunction with the accompanying drawings wherein.

DETAILED DESCRIPTION

Figure 1:
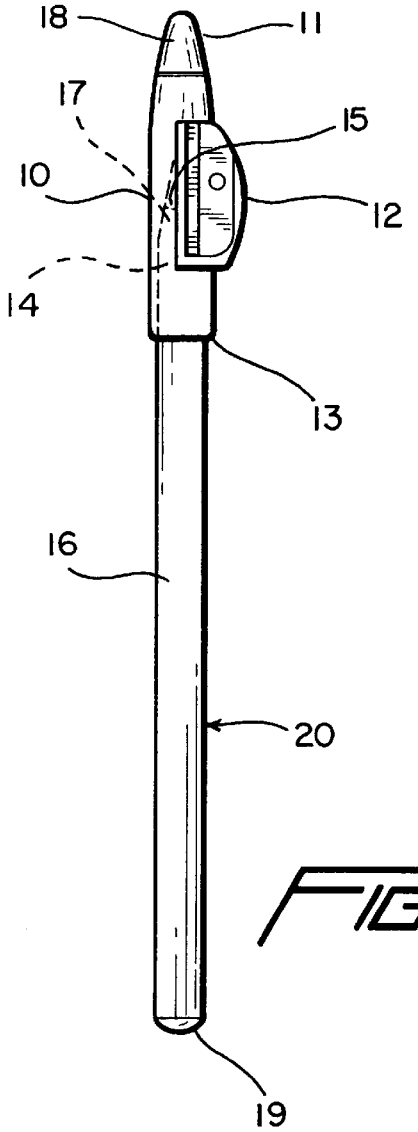
FIG. 1 is a front view of the pencil sharpener cap in a closed positioned engaging a cosmetic pencil.
Figure 2:
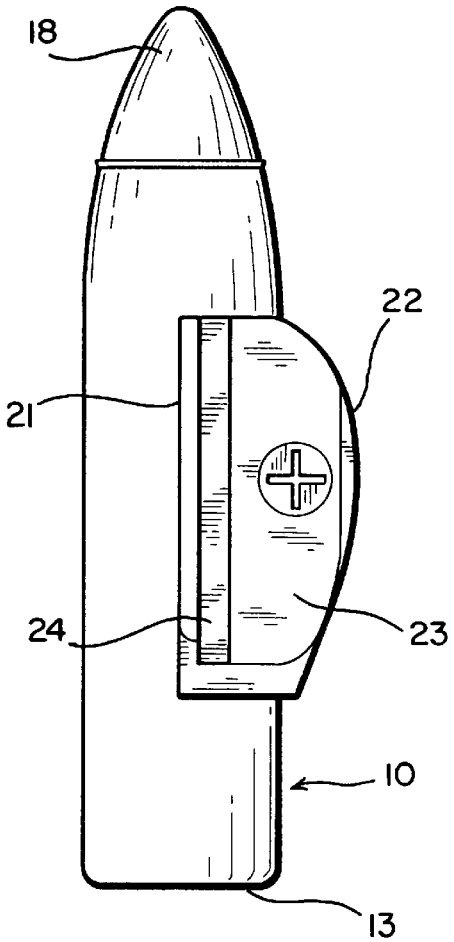
FIG. 2 is an enlarged view of the sharpener cap showing the blade.

Referring now to the drawings, this invention comprises a cap 10 having a top 11 at one end and a downwardly extending wall 12 with a substantially circular recess 13 extending longitudinally within said wall 12. The cap recess 13 engages the head 14 of a cosmetic pencil 20 to permit carrying the pencil 20 without the cosmetic 15 contacting clothing or other items in a pocketbook. It also prevents snagging in pockets and pocketbooks.

The cosmetic pencil 20 comprises a central longitudinal element of compressed cosmetic 15 surrounded by a wood sheath 16 as in a lead pencil. The pencil 20 includes a head 14 at one end with the sharpened pencil head 14 protruding from a conically shaved portion 17. The cosmetic pencil 20 is subject to wear and consequently must be sharpened frequently. This necessitates the use of a sharpener, which is not always available or convenient to use.

The pencil 20 also includes a metal or plastic cap 19 at the opposite end to protect the cosmetic 15 within the wood sheath 16 and to seal the end of the pencil 20. Another metal or plastic cap 18 may be mounted on the top of the cap 10. Cap 18 may be removed from cap 10 to facilitate cleaning of the wood shavings by pulling to release the outwardly biased prong 27. These caps 18 and 19 also serve a decorative function.

The cap 10 includes an axial slot 21 in the wall 12 having a flat surface 22 protruding upwardly at an angle. The flat surface 22 has a blade 23 mounted thereto with a cutting edge 24 extending downwardly into the slot 21 to engage the head 14 of the cosmetic pencil 20. The rear portion 25 of the flat surface 22 protrudes upwardly in an arc from the cap wall 12 and is rounded in a smooth configuration to eliminate the problem of snagging. An additional support portion 26 is molded into the rear portion 22 to provide further backing during use of the blade 23. The cap 10 itself is a unitary one-piece structure.

Figure 6:
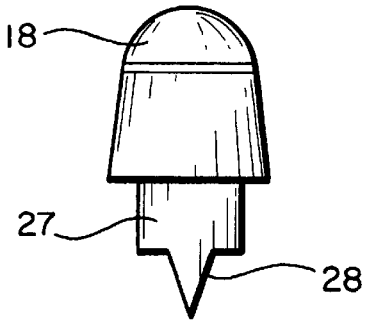
FIG. 6 is a front view of the cap top showing a chisel-like protrusion for cleaning purposes; and, FIG. 7 is a cross sectional view of the cap taken along the line 7—7 of FIG. 6.
Figure 7:
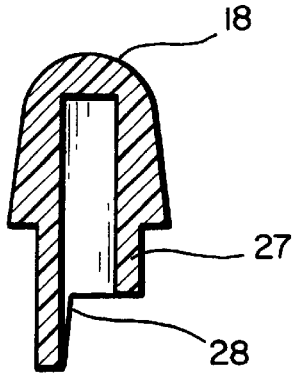
Figure 3:
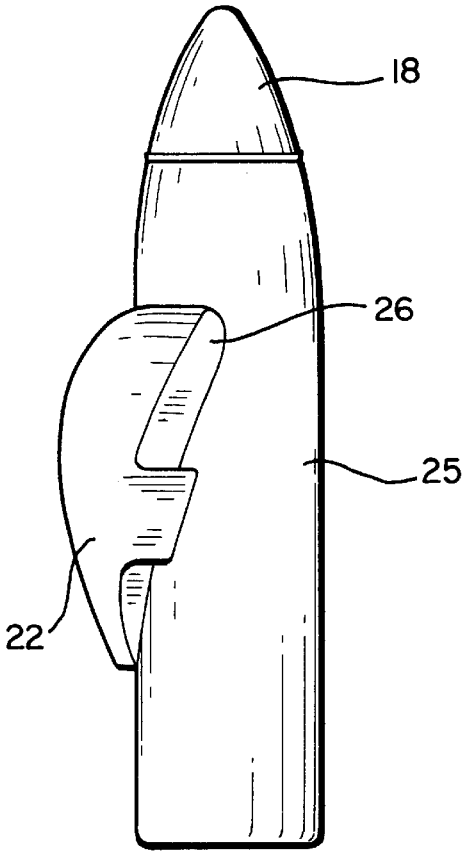
FIG. 3 is a rear view showing an upwardly extending portion of the cap which has a rounded rear surface to support the blade on a flat forward surface.
Figure 4:
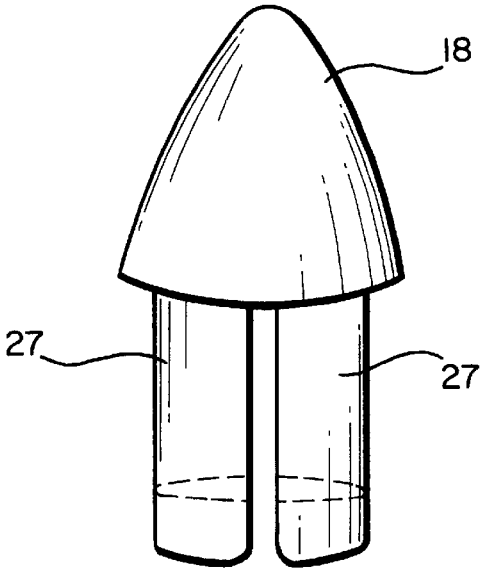
FIG. 4 is a front view of the end cap which mounts on the pencil cap.
Figure 5:
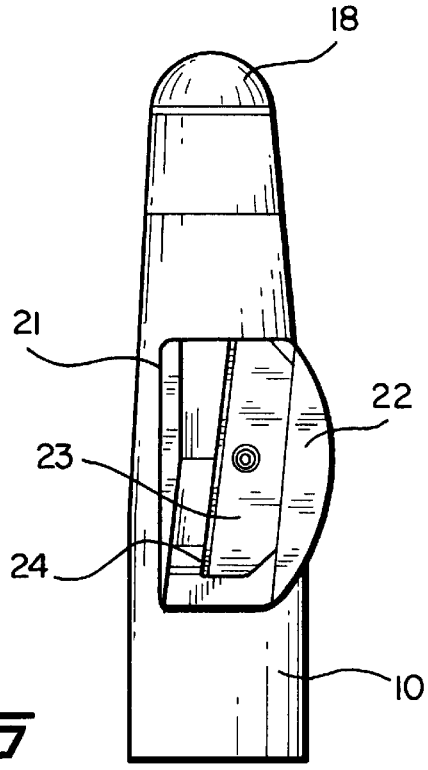
FIG. 5 is an enlarged view of an alternate embodiment of the invention showing the cap with a self-cleaning portion.

As shown in FIGS. 5–7, the cap may include a self-cleaning portion which comprises a top 18 having a downwardly extending intermediate portion 27 and a chisel-like protrusion 28 on the lower end 29. The protrusion 28 removes debris which accumulates between the cutting edge of the blade 24 and the slot 21. Thus, the debris which comprises wood shavings and cosmetic 15 is directed outwardly from the slot 21 to prevent the slot 21 from becoming clogged with cosmetic and wood shavings 15.

In operation, the cap 10 is held firmly and the elongated pencil 20 is turned. The blade 23 engages the head 14 of the pencil 20 and shaves the wood sheath 16 and cosmetic 15 to form a point on the cosmetic pencil 20. The wood shavings and excess cosmetic 15 are ejected from the slot 21 by the chisel-like protrusion 28 maintaining the slot 21 clear. Thus the invention provides an attractive, inexpensive and convenient means to sharpen cosmetic pencils.

While the invention has been explained by a detailed description of certain specific embodiments, it is understood that various modifications and substitutions can be made in any of them within the scope of the appended claims, which are intended also to include equivalents of such embodiments.

What is claimed is:

1. A cosmetic pencil and sharpener comprises:

a cosmetic pencil having an elongated body portion having a first and second end; said body portion comprising an axial cosmetic element and a wood sheath surrounding said element, a head portion at the first end of the body portion and shielding means mounted on the second end, wherein said head portion includes a tapered sheath portion having a tapered cosmetic element protruding outwardly therefrom;

a top cap portion including a hollow end cap, an outer wall extending downwardly therefrom, an inwardly extending portion and a recessed portion extending downwardly from the inwardly extending portion including an end cleaning portion; and, a lower cap portion having an axial recess to engage the head portion of the pencil, an outer wall engaging the outer wall on the top cap portion, an elongated slot in said wall, an outwardly protruding portion on said wall adjacent the slot having a blade mounted thereto and extending into the slot to engage the head portion of the pencil for sharpening purposes.

2. A cosmetic pencil and sharpener in accordance with claim 1 wherein:

the cleaning portion of the top cap portion comprises a chisel-like protrusion that removes the wood sheath and cosmetic that accumulates between the slot and the blade.

3. A cosmetic pencil and sharpener in accordance with claim 2 wherein:

the protruding portion on the top cap wall comprises a rounded configuration integrally formed on the cap wall at an angle to the axis thereof.

4. A cosmetic pencil and sharpener in accordance with claim 2 wherein:

the blade includes a cutting edge extending into the slot to engage the head of the cosmetic pencil at an angle to form a tapered sheath portion.

5. A cosmetic pencil and sharpener in accordance with claim 4 further including:

adjustable mounting means for securing the blade to the flat surface at a predetermined angle.

6. A cosmetic pencil and sharpener in accordance with claim 2 wherein:

the cleaning portion protrusion is positioned adjacent the slot to engage the wood sheath and cosmetic removed by the blade from the sharpened head.

* * * * *

UNITED STATES PATENT AND TRADEMARK OFFICE

CERTIFICATE OF CORRECTION

PATENT NO. : 6,568,090 B2 
DATED : May 27, 2003
INVENTOR(S) : Robert Sheffler and Charles Chang It is certified that error appears in the above-identified patent and that said Letters Patent is hereby corrected as shown below:

Title page,
Insert as follows:
-- [73] Assignee: Charles Chang, Wayne, NJ (US) --

Signed and Sealed this

Twenty-third Day of September, 2003

JAMES E. ROGAN
*Director of the United States Patent and Trademark Office*